US009195191B2

(12) United States Patent
Sugawara et al.

(10) Patent No.: US 9,195,191 B2
(45) Date of Patent: Nov. 24, 2015

(54) FIXING MEMBER FOR ELECTROPHOTOGRAPHIC FIXING, FIXING DEVICE, AND IMAGE FORMING APPARATUS

(71) Applicants: Tomoaki Sugawara, Kanagawa (JP); Tsuneaki Kondoh, Kanagawa (JP); Junichiro Natori, Kanagawa (JP)

(72) Inventors: Tomoaki Sugawara, Kanagawa (JP); Tsuneaki Kondoh, Kanagawa (JP); Junichiro Natori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/148,890

(22) Filed: Jan. 7, 2014

(65) Prior Publication Data

US 2014/0199102 A1 Jul. 17, 2014

(30) Foreign Application Priority Data

Jan. 11, 2013 (JP) ..... 2013-003163

(51) Int. Cl.
*G03G 15/20* (2006.01)

(52) U.S. Cl.
CPC ..... *G03G 15/2057* (2013.01); *G03G 15/206* (2013.01); *G03G 15/2053* (2013.01); *G03G 2215/2048* (2013.01)

(58) Field of Classification Search
CPC ..... G03G 15/2057; G03G 2215/2048
USPC ..... 399/333
See application file for complete search history.

(56) References Cited

U.S. PATENT DOCUMENTS

| | | | | |
|---|---|---|---|---|
| 5,786,065 | A * | 7/1998 | Annis et al. | 428/141 |
| 7,593,680 | B2 * | 9/2009 | Shinshi | 399/329 |
| 8,099,035 | B2 * | 1/2012 | Qi et al. | 399/333 |
| 8,369,764 | B2 * | 2/2013 | Sugawara | 399/333 |
| 2004/0069404 | A1 | 4/2004 | Kondoh | |
| 2004/0224165 | A1 | 11/2004 | Kondoh et al. | |
| 2005/0095381 | A1 | 5/2005 | Kondoh | |
| 2005/0207806 | A1 | 9/2005 | Yoshii et al. | |
| 2006/0014021 | A1 * | 1/2006 | Sugawara et al. | 428/421 |
| 2006/0188300 | A1 * | 8/2006 | Matsunaka et al. | 399/333 |
| 2006/0198666 | A1 | 9/2006 | Kondoh et al. | |
| 2007/0140758 | A1 | 6/2007 | Aze et al. | |
| 2009/0003903 | A1 | 1/2009 | Katano et al. | |
| 2009/0263584 | A1 | 10/2009 | Katano et al. | |
| 2010/0119269 | A1 | 5/2010 | Kondoh et al. | |
| 2010/0129123 | A1 | 5/2010 | Natori et al. | |
| 2010/0209154 | A1 * | 8/2010 | Kim et al. | 399/333 |
| 2010/0222193 | A1 * | 9/2010 | Motokawa et al. | 492/18 |
| 2010/0279045 | A1 * | 11/2010 | Nakajima et al. | 428/36.9 |
| 2011/0013957 | A1 | 1/2011 | Katano et al. | |
| 2011/0045724 | A1 * | 2/2011 | Bahukudumbi | 442/57 |
| 2012/0014726 | A1 * | 1/2012 | Sekihara et al. | 399/333 |

(Continued)

FOREIGN PATENT DOCUMENTS

| | | |
|---|---|---|
| JP | 2005-292218 | 10/2005 |
| JP | 2007-179009 | 7/2007 |

(Continued)

*Primary Examiner* — David Gray
*Assistant Examiner* — Geoffrey Evans
(74) *Attorney, Agent, or Firm* — Cooper & Dunham LLP

(57) ABSTRACT

A fixing member for electrophotographic fixing includes a base body; an elastic layer; and an outermost surface releasing layer. The elastic layer and the outermost surface releasing layer are laminated on the base body. The elastic layer is a continuous layer including fibrous filler distributed in a portion of the elastic layer towards the outermost surface releasing layer.

8 Claims, 3 Drawing Sheets

(56) References Cited

U.S. PATENT DOCUMENTS

| | | | | |
|---|---|---|---|---|
| 2012/0322967 | A1 | 12/2012 | Kondoh et al. | |
| 2014/0154512 | A1* | 6/2014 | Dooley et al. | 428/411.1 |
| 2014/0255068 | A1* | 9/2014 | Matsunaka et al. | 399/333 |
| 2015/0030363 | A1* | 1/2015 | Sugawara et al. | 399/333 |
| 2015/0160596 | A1* | 6/2015 | Asaka et al. | 399/333 |
| 2015/0177654 | A1* | 6/2015 | Arizumi et al. | 399/333 |

FOREIGN PATENT DOCUMENTS

| | | |
|---|---|---|
| JP | 2009-103882 | 5/2009 |
| JP | 2010-066509 | 3/2010 |
| JP | 2010-092008 | 4/2010 |
| JP | 2010-152303 | 7/2010 |
| JP | 2010-170132 | 8/2010 |
| JP | 2011-237681 | 11/2011 |

* cited by examiner

FIXING MEMBER FOR ELECTROPHOTOGRAPHIC FIXING, FIXING DEVICE, AND IMAGE FORMING APPARATUS

CROSS-REFERENCE TO RELATED APPLICATIONS

This patent application is based on and claims priority pursuant to 35 U.S.C. §119 from Japanese Patent Application No. 2013-003163, filed on Jan. 11, 2013 in the Japan Patent Office, which is hereby incorporated by reference herein in its entirety.

BACKGROUND

1. Technical Field

The present disclosure generally relates to a fixing member for toner fixing, a fixing device, and an image forming apparatus.

2. Related Art

An electrophotographic image forming apparatus, such as a copier or a printer, includes an image forming unit for forming a color image formed of toner of, for example, four colors (e.g., yellow, magenta, cyan, and black) on a recording medium and a fixing device for fixing the formed color image onto the recording medium. The fixing device includes a fixing member for fixing (hereinafter, simply referred to as "fixing member") the color image onto the recording medium by heating and a pressing member forming a fixing nip with the fixing member. When the recording medium goes through the fixing nip, the fixing device fixes the color image formed of toner images of the four colors onto the recording medium with heat and pressure.

The fixing member is generally a roller shape or a belt shape. The fixing member has an elastic layer formed on a metal roller or a resin seamless belt and a heater in the metal roller or the resin seamless belt. The elastic layer includes a synthetic rubber such as silicone rubber. However, due to the elastic layer having small heat conductivity and large heat capacity, the warm up time may increase. To improve heat conductivity, it is proposed to include fillers in the elastic layer or a releasing layer.

In addition, the fixing member preferably has an elasticity that encompasses, melts, and mixes the toner of the four colors forming the color image when fixing the color image. Accordingly, the releasing layer formed of material with small elasticity such as a fluorine resin has a tendency to be thin.

JP-2005-292218-A discloses a roller for a fixing device with improved heat conductivity and shape stability of a silicone rubber by coating a fluorine resin on an outer circumference of an elastic layer formed of the silicone rubber including carbon fibers.

JP-2010-092008-A discloses a fixing belt having an elastic layer in which a blending ratio of fillers and carbon nanotubes (hereinafter referred to as CNT) is set within a predetermined range to obtain a desired elasticity, improved heat conductivity, and good mechanical fixing strength.

However, the above-described roller or belt uniformly disperses the carbon fibers or the CNTs within the whole elastic layer, which makes the elastic layer hard. When the elastic layer of above-described roller or belt is used with a recording medium having high surface unevenness, the elastic layer may not be able to follow the high surface unevenness, thus causing defective fixing.

JP-2010-170132-A discloses a fixing member including a base body, an elastic layer, and a releasing layer formed of a fluorine resin including fluorinated CNTs. The fixing member exhibits improved heat conductivity and improved mechanical strength. Accordingly, extended operation life is obtained. However, due to the releasing layer being hard, the difference in the degree of deformation between the elastic layer and the releasing layer is large. Accordingly, the releasing layer is susceptible to coming off, and to prevent the releasing layer from coming off, the elastic layer has a relatively small thickness to lower the degree of deformation. As a result, surface following capability in heating for fixing is insufficient.

A fixing member with an intermediate layer (or a primer layer) including fillers between an elastic layer and a releasing layer is also known. For example, JP-2010-066509-A discloses a fixing belt including a primer layer that contacts a surface layer having a fluorine resin. The primer layer includes a fluorine resin and inorganic fillers, and particle size distribution of the inorganic fillers is adjusted to a predetermined range. JP-2009-103882-A discloses a pressing roller including an adhesive layer for bonding an elastic layer and a releasing layer. Fillers of anisotropic property having high heat conductivity are included in the adhesive layer. The fillers are arranged in a longitudinal direction of the pressing roller. JP-2007-179009-A discloses a fixing member with an intermediate layer of a fluorine resin including carbon clusters such as fullerene and CNT. The intermediate layer is disposed between an elastic layer and a releasing layer.

However, in recent years, the demand for support of various types of recording media, in particular, support for thick papers has increased in the field of electrophotography. The above-described fixing members of JP-2010-066509-A, JP-2009-103882-A, and JP-2007-179009-A have a large difference in hardness between the elastic layer and the releasing layer or between the elastic layer and the intermediate layer. Thus, when a thick paper is employed, stress from deformation at an end portion of the thick paper concentrates at a bonding portion (i.e., interface) between the elastic layer and the releasing layer or the intermediate layer. As a result, plastic deformation of the releasing layer or the intermediate layer may occur, or the releasing layer or the intermediate layer may come off from the elastic layer.

JP-2010-152303-A discloses a fixing member including a surface elastic layer of porous fluorosilicone rubber with carbon fibers uniformly dispersed. JP-2011-237681-A discloses a foamed elastic layer including fluorosilicone rubber, and carbon fibers surface treated with a fluorine resin dispersed within the foamed elastic layer. However, when a releasing layer wears down, the carbon fibers may become exposed on the surface, resulting in a decline of releasing property.

SUMMARY

In view of the foregoing, in an aspect of this disclosure, there is provided a novel fixing member for electrophotographic fixing including a base body, an elastic layer, and an outermost surface releasing layer. The elastic layer and the outermost surface releasing layer are laminated on the base body. The elastic layer is a continuous layer including fibrous filler distributed in a portion of the elastic layer towards the outermost surface releasing layer.

The aforementioned and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
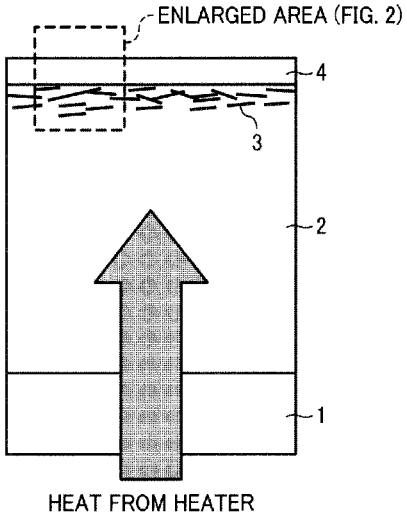
FIG. 1 is a schematic view of a configuration of a fixing member for fixing according to an embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In view of the foregoing, in an aspect of this disclosure, there is provided a novel fixing member in which plastic deformation does not occur even when large deformation is generated in fixing that employs a recording medium such as thick paper.

Referring now to the drawings, exemplary embodiments of a fixing member of the present invention are described below.

Figure 2:
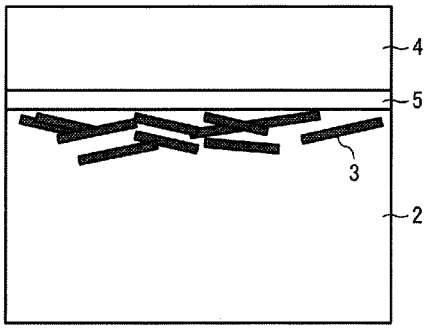
FIG. 2 is an enlarged view of an area near a surface of the fixing member.

FIG. 1 is a schematic view of a configuration of a fixing member for fixing (hereinafter simply referred to as "fixing member") according to an embodiment of the present invention. FIG. 2 is an enlarged view of an area near a surface of the fixing member.

The fixing member for electrophotographic fixing according to an embodiment of the present invention includes an elastic layer 2 and an outermost surface releasing layer 4 that are laminated on a base body 1. The elastic layer 2 is a continuous layer and includes fibrous fillers 3 distributed at a portion of the elastic layer 2 towards the outermost surface releasing layer 4. The term "continuous layer" used herein means that, except for the fibrous fillers 3, the elastic layer 2 entirely has the same composition of elastic material.

Figure 3:
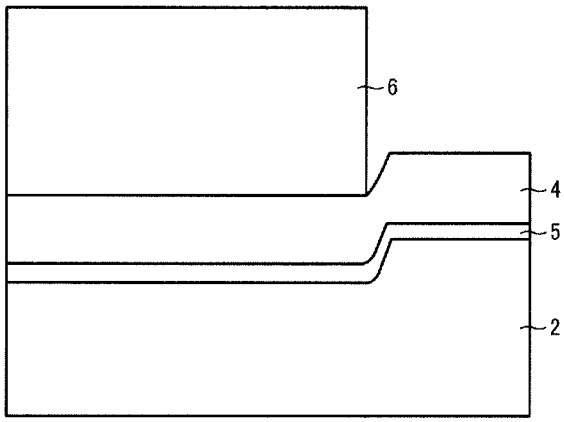
FIG. 3 RELATED ART
FIG. 3 is a schematic view of a state of stress at an end portion of a medium in a fixing member with a conventional configuration.

FIG. 3 is a schematic view of a state in which a thick sheet is fixed with a fixing member including the outermost surface releasing layer 4 and a primer layer (i.e., intermediate layer) 5 with fillers dispersed in a conventional configuration. A portion of the elastic layer 2 at which the thick sheet is situated receives stress and deforms, and a portion of the elastic layer 2 at which the thick sheet is not situated does not practically deform. As a result, a difference in level (i.e., large strain) is generated. The outermost surface releasing layer 4 and the primer layer 5 are often formed of material susceptible to plastic deformation and, in addition, includes the fillers, and thus has a low elasticity. Due to the difference in level at an end portion of the thick sheet, large stress is locally received and plastic deformation occurs. As a result, a line or groove on the surface of the fixing member is generated. When the fixing member having the line or groove on the surface is employed to fix an image, an abnormal image is generated.

Figure 4:
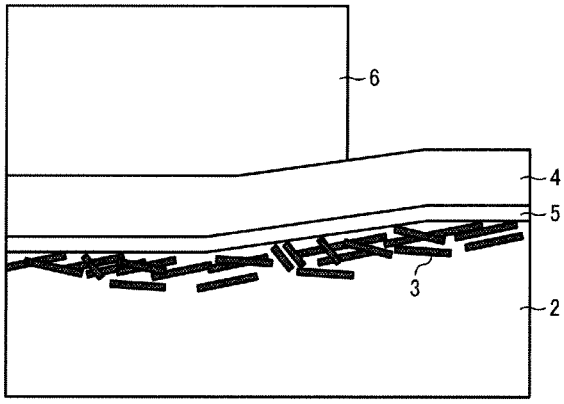
FIG. 4 is a schematic view of a state of stress at an end portion of paper according to an embodiment of the present invention.

In the elastic layer 2, as shown in FIG. 4, the fibrous fillers 3 are distributed at the portion of the elastic layer 2 towards the outermost surface releasing layer 4. As a result, the side towards the outermost surface releasing layer 4 of the elastic layer 2 is hard and the side towards the base body 1 of the elastic layer 2 has high elasticity. Stress locally applied to the elastic layer 2 by a medium 6 to be fixed with a toner image (hereinafter, simply referred to as "medium 6") is dispersed over a broad area due to a random overlapping of the fibrous fillers 3, Accordingly, the elastic layer 2 does not locally deform. Due to an elasticity of a portion in which the fibrous fillers 3 are dispersed, the elastic layer 2 moderately deforms thus following a surface unevenness of the medium 6. Further, as described above, the elastic layer 2 is the continuous layer with no bonding interface. Thus, even if stress is received locally, the portion with the fibrous fillers 3 does not come off from the portion without the fibrous fillers 3. In addition, plastic deformation of the portion with the fibrous fillers 3 does not occur. Furthermore, although the outermost surface releasing layer 4 and the primer layer 5, which is provided between the outermost surface releasing layer 4 and the elastic layer 2, are formed of a material(s) subject to plastic deformation, local deformation of the elastic layer 2 like the above-described conventional composition does not occur when stress is received locally. Accordingly, the outermost surface releasing layer 4 and the primer layer 5 follow the deformation of the elastic layer 2, thus preventing the outermost surface releasing layer 4 and the primer layer 5 from plastically deforming and coming off the elastic layer 2. As a result, the generation of abnormal images is prevented.

<Elastic Layer>

The elastic layer 2 according to an embodiment of the present invention has a synthetic rubber as a main component of the elastic material, and includes the fibrous fillers 3 at the portion of the elastic layer 2 towards the outermost surface releasing layer 4. A general-purpose additive such as a filler agent may be included according to need. Specific examples of the synthetic rubber include, but are not limited to, silicone rubber, fluororubber, fluorosilicone rubber, and a combination of two or more of the above-described specific examples. The silicone rubber is preferable.

Specific examples of the material used for the fibrous fillers 3 include, but are not limited to, carbon fibers and glass fibers. The carbon fibers may be polyacrylonitrile (PAN)-based carbon fibers made from synthetic fibers of acrylic long fibers and pitch-based carbon fibers made from coal tar and petroleum pitch. A mixture of the above-described specific examples may be also employed.

The PAN-based carbon fibers are obtained by carbonizing PAN precursors (polyacrylonitrile fibers) and have properties of high strength and high elastic modulus. The pitch-based carbon fibers are obtained by carbonizing pitch precursors (e.g., coal tar or pitch fiber obtained from heavy petroleum fractions as raw material) and, according to conditions of manufacture, a broad range of properties from low elastic modulus to extremely high elastic modulus and high strength are obtained. The extremely high elastic modulus and high strength pitch-based carbon fibers have good heat conductivity and good electrical conductivity and are preferably used.

The average length of the fibrous fillers 3 is preferably in a range from approximately 30 μm or more to approximately 300 μm or less, and more preferably in a range from approximately 50 μm or more to approximately 250 μm or less. When the length of the fibrous fillers 3 is less than approximately 30 μm, stress dispersion capability declines and local deformation may occur. When the length of the fibrous fillers 3 is approximately 300 μm or more, uniformly dispersing the fibrous fillers 3 at the portion of the elastic layer 2 towards the outermost surface releasing layer 4 becomes difficult.

The content amount of the fibrous fillers 3, although depending upon the type of fillers, is preferably at a ratio of approximately 10 or more to approximately 30 or less relative to 100 of synthetic rubber. When the content amount of the fibrous fillers 3 is less than approximately 10, a sufficient effect of adding the fibrous fillers 3 may not be obtained. When the content amount of the fibrous fillers 3 is more than approximately 30, the fibrous fillers 3 enters into an inner portion of the elastic layer 2 and the elasticity of the elastic layer 2 may decline.

The thickness of the elastic layer 2 is preferably in a range of approximately 250 μm or more to approximately 5 mm or less though the thickness of the elastic layer 2 also depends upon the thickness of the medium 6. When the thickness of the elastic layer 2 is less than approximately 250 μm, deformation amount is small and may result in insufficient fixing of the medium 6 with an uneven surface. When the thickness of the elastic layer 2 is more than approximately 5 mm, heat-up time may increase.

The elastic layer 2 is formed by coating a synthetic rubber solution using publicly known coating methods such as spray coating, blade coating, and dipping coating; applying the fibrous fillers 3 before a coated synthetic rubber layer hardens; and vulcanizing the coated synthetic rubber layer after the fibrous fillers 3 adapts.

<Outermost Surface Releasing Layer>

The outermost surface releasing layer 4 provides releasing property and wear-resistant property to the fixing member. The outermost surface releasing layer 4 is formed with a fluorine-based polymer material as a main component. The term "main component" used herein means that the fluorine-based polymer material is included in the outermost surface releasing layer 4 at a ratio sufficient to exhibit a property of the fluorine-based polymer material.

The fluorine-based polymer material preferably has a good melt film forming property by firing and a relatively low melting point. Preferably, the relatively low melting point is approximately 250° C. to approximately 300° C. More specifically, the fluorine-based polymer material includes, but are not limited to, fine powders or tubes of low molecular weight polytetrafluoroethylene (PTFE), tetrafluoroethylene/hexafluoropropylene copolymer (FEP), or tetrafluorothylene/perfluoroalkyl-vinylether copolymer (PFA).

Specific examples of low molecular weight polytetrafluoroethylene (PTFE) include, but are not limited to, Lubron L-5 and L-2 from Daikin Industries, and MP1100, 1200, 1300, and TLP-1 from Du-pont Mitsui Fluorochemicals Co., Ltd. Specific examples of tetrafluoroethylene/hexafluoropropylene copolymer (FEP) include, but are not limited to, 532-8000 from Du-pont Kabushiki Kaisha. Specific examples of tetrafluorothylene/perfluoroalkyl-vinylether copolymer (PFA) include, but are not limited to, MP-10 and MP102 from Du-pont Mitsui Fluorochemicals Co., Ltd. Particularly, MP103 and MP300 from Du-pont Mitsui Fluorochemicals Co., Ltd. and AC-5600 and AC5539 from Daikin Industries have a small melt flow rate (hereinafter referred to as MFR) and low flow properties and are preferably used.

The outermost surface releasing layer 4 may include an additive such as a filler agent, an antioxidant, a pigment, a colorant, a surfactant, a plasticizer, a thickener, a wax, or an oil according to objective as long as releasing property and wear-resistant property is not impaired. The total amount of the additive is preferably kept in approximately 1% by weight to approximately 10% by weight of the whole of the outermost surface releasing layer 4.

The thickness of the outermost surface releasing layer 4 is preferably approximately 1 μm or more to approximately 15 μm or less. When the thickness of the outermost surface releasing layer 4 is less than approximately 1 μm, durability may decline. When the thickness of the outermost surface releasing layer 4 is more than approximately 15 μm, the following capability of a surface unevenness of the medium 6 may decline due to low elasticity of the fluorine-based polymer material.

For the outermost surface releasing layer 4, a coating layer is formed by, for example, bonding a heat contraction tube or coating (e.g., spray-coating) an outermost surface releasing layer coating liquid, and afterwards, by heating to a temperature above the melting point of a fluorine-based resin for melting and firing. The outermost surface releasing layer 4 may also be formed by employing, for example, a powder coating of the fluorine-based resin in electrodeposition coating.

<Base Body>

The base body 1 may be a belt or a roller. When the base body 1 is a belt, preferably the belt is a seamless belt formed of, for example, a resin such as polyimide resin, polyamide resin, polyamide-imide resin, and fluorine based resin, or a metal such as nickel or stainless. When the base body 1 is a roller, preferably the roller is a pipe formed of, for example, a metal such as aluminum, stainless steel, or brass.

<Primer Layer (Intermediate Layer)>

According to need, the fixing member according to an embodiment of the present invention may include the primer layer that enhances adhesion between the base body 1 and the elastic layer 2, and/or adhesion between the elastic layer 2 and the outermost surface releasing layer 4.

<Fixing Device>

Figure 5:
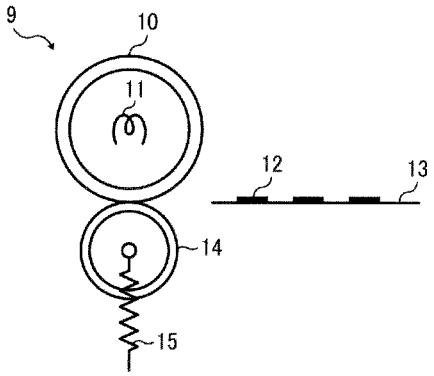
FIG. 5 is a schematic view of a fixing device according to an embodiment of the present invention.

FIG. 5 is a schematic view of a fixing device according to an embodiment of the present invention.

The fixing device 9 includes a fixing member 10 for fixing (hereinafter, simply referred to as "fixing member 10") having a heater 11 inside the fixing member 10, and a pressing roller 14 that presses and contacts the fixing member 10 by a pressing mechanism 15. Fixing is conducted by passing through a medium 13 with a toner image 12 on the medium 13 between the fixing member 10 and the pressing roller 14.

<Image Forming Apparatus>

Figure 6:
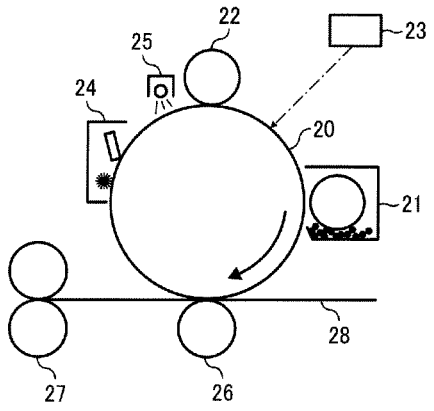
FIG. 6 is a schematic view of an image forming apparatus according to an embodiment of this disclosure.

FIG. 6 is a schematic view of an image forming apparatus according to an embodiment of the present invention.

In FIG. 6, a photoreceptor 20 has a drum shape though may be a sheet shape or an endless belt shape. Disposed around the photoreceptor 20 are a charging device 22, an image exposing device 23, a developing device 21, a transfer device 26, a cleaning device 24, and a neutralizing device 25. The photoreceptor 20 is charged and an electrostatic latent image is formed on the photoreceptor 20 with the image exposing device 23, and the electrostatic latent image is developed with the developing device 21 into a toner image 12. The developed toner image 12 on the photoreceptor 20 is transferred onto a medium 28 by the transfer device 26, and the fixing device 27 according to an embodiment of the present invention fixes the toner image 12 onto the medium 28. As a result, an image is formed on the medium 28.

EXAMPLES

Further understanding can be obtained by reference to specific examples, which are provided hereinafter. However, it is to be understood that the embodiments of the present invention are not limited to the following examples.

Example 1

The following procedure is conducted. An uncured addition-type liquid silicone DY35-2083 (from Toray Industries, Inc.) is coated over a primer on an aluminum hollow metal core with a ribbed thickness of 0.4 mm. The aluminum hollow metal core is disposed horizontally and slowly rotated. With respect to the uncured silicone rubber, a pitch-based carbon fiber powder XN-100 having a fiber length 50 μm (from Nippon Graphite Fiber Co., Ltd.) is flung up with compressed air and attached to the surface of the silicone rubber. The aluminium hollow metal core with attached pitch-based carbon fiber powder is kept rotating for approximately 20 minutes to adapt the pitch-based carbon fiber powder to the surface and then heated at 120° C. for 30 minutes. As a result, an elastic layer with a thickness of 500 μm is obtained. The blending amount of the pitch-based carbon fiber powder is weighed at each process and the amount of adhering pitch-based carbon fiber powder is estimated. On the outer circumference of the aluminium hollow metal core with attached pitch-based carbon fiber powder is bonded a PFA resin tube having a thickness of 10 μm with an attached primer layer. A secondary vulcanization at 200° C. for four hours is conducted, and thus an example 1 of the fixing member is prepared.

Example 2

The procedure in Example 1 is repeated except for replacing the pitch-based carbon fiber with a pitch-based carbon fiber XN-100 having a fiber length 150 μm (from Nippon Graphite Fiber Co., Ltd.). Thus, an example 2 of the fixing member is prepared.

Example 3

The procedure in Example 1 is repeated except for replacing the pitch-based carbon fiber with a pitch-based carbon fiber XN-100 having a fiber length 250 μm (from Nippon Graphite Fiber Co., Ltd.). Thus, an example 3 of the fixing member is prepared.

Example 4

The procedure in Example 1 is repeated except for replacing the pitch-based carbon fiber with a PAN-based carbon fiber TORAYCA milled fiber MLD-300 having a fiber length 130 μm (from Toray Industries, Inc.). Thus, an example 4 of the fixing member is prepared.

Example 5

The procedure in Example 1 is repeated except for replacing the pitch-based carbon fiber with a glass fiber MLD-300 having a fiber length 100 μm (from Asahi Fiber Glass Co., Ltd.). Thus, an example 5 of the fixing member is prepared.

Comparative Example 1

The procedure in Example 1 is repeated except for not adding the pitch-based carbon fiber. Thus, an example 6 of the fixing member is prepared.

Comparative Example 2

[Addition of Inorganic Fillers to the Primer Layer]

Inorganic fillers ALUMINA AA-2, spherical form, maximum diameter M average 2 μm (from Sumitomo Chemical Co., Ltd.) are dispersed ultrasonically within water including an inorganic filler dispersant DEMOLN (from Kao Corporation). The obtained dispersion liquid is blended with a primer 855N-023 (from Du-pont Kabushiki Kaisha) and agitated with an agitator. Thus, a primer liquid is prepared. (The blending amount of the inorganic fillers is 30 Vol % with respect to a primer resin.) The procedure in Comparative example 1 is repeated. A silicone rubber layer (i.e., elastic layer) is formed and after a primary firing of the silicone rubber layer, the silicone rubber layer is immersed (i.e., dipping method) into the primer liquid and pulled out to coat the primer liquid on the outer circumferential surface of the silicone rubber layer. The coated primer liquid is heated at 100° C. for 30 minutes to solidify. Thus, a primer layer with a thickness of 3 μm is formed on the outer circumferential surface of the silicone rubber layer. On the outer circumference of the primer layer, a PFA resin tithe having a thickness of 10 μm is bonded, a secondary vulcanization at 200° C. for four hours is conducted and an example 7 of the fixing member is prepared.

The examples 1 to 7 are set, respectively, in a fixing unit of a MF4570 copier (from Ricoh Company, Ltd.). For each of the examples 1 to 7, 50,000 sheets of Ricoh full color copy paper type 6000 (90W) having a sheet thickness of 120 μm with a toner solid image are fed. After the sheets pass through the fixing unit, a difference in level, Martens hardness prior to passing of the sheets, and difference in temperature rise at a sheet end portion is measured with respect to each of the examples 1 to 7 according to the following methods.

The composition of the elastic layers and evaluation results are shown in Table 1. A blending amount of fibrous fillers is determined as follows. The weight of a silicone rubber is determined by subtracting a pre-measured weight of a metal core and a primer from the weight after coating the silicone rubber on the metal core and the primer. The weight of the fibrous fillers is determined by subtracting the weight of a silicone rubber adhering to the metal core from the weight of the silicone rubber adhering to the metal core with the fibrous fillers. For example, with respect to Example 1, when the weight of the silicone rubber is converted to 100, the weight of the pitch-based carbon fiber powder has a ratio of 21 relative to 100 of the weight of the silicone rubber. Thus, the pitch-based carbon fiber powder exists in the elastic layer in a weight ratio of 21/(100+21). However, obviously, due to the method of adhering the pitch-based carbon fiber powder, the pitch-based carbon fiber powder adheres to the surface, and thus the weight ratio represents simply a weight ratio of the pitch-based carbon fiber powder relative to the whole elastic layer.

[Measurement of Difference in Level]

The difference in level after passing of the sheet is measured by measuring, with respect to the fixing member, a peak depth of a concavity at a 5 mm end portion of the sheet with a VK9500 laser microscope (from Keyence Corporation).

[Martens Hardness]

A measurement of hardness, which indicates deformation difficulty of the film formed fixing member with respect to an assumed depth, is evaluated with the Martens hardness test (15014577). More specifically, the measurement of hardness is conducted at an environment of 25° C. temperature, employing a Fischerscope H100C (from Fischer Instruments K.K.) set at a depth of 5 μm from an outermost surface. In the above-described Examples and Comparative Examples, an outermost surface releasing layer having a thickness of 10 μm is formed and thus, the above-described measurement settings are set so as not to penetrate the outermost surface releasing layer. It is to be noted that the PFA tube employed as the outermost surface releasing layer, for example, a PFA tube with a thickness of 30 μm, has a hardness of 6.7 N/mm$^2$ at a depth of 5 μm and the silicone rubber DY35-2083 with a thickness of 100 μm (from Toray Industries, Inc.) employed as the elastic layer has a hardness of 0.35 N/mm$^2$ at a depth of 5 μm.

[Difference in Temperature Rise of the Sheet End Portion]

The difference in temperature rise at a sheet end portion of each of the examples 1 to 7 is measured by disposing a thermocouple, with the sheet end portion as the center, at 10 mm both inside and outside of a nip exiting portion, and measuring a temperature difference 10 minutes after start of passing of the sheets.

[Evaluation on Wearing-Resistant Property]

Flaws of the surface of each of the examples 1 to 7 are caused by frictional wear from edge portions of the sheets. The occurrence of abnormal images due to the flaws of the surface of each of the examples 1 to 7 is measured.

1: Flaws significantly inhibit image fixing property and partial defective fixing is observed.
2: Difference in gloss due to wear marks is observed and is evaluated as an abnormal image.
3: Difference in gloss due to wear marks is observed but is at an acceptable level.
4: Not abnormal

TABLE 1

| Blending (Weight) | Comp. Ex. 1 | Ex. 1 | Ex. 2 | Ex. 3 | Ex. 4 | Ex. 5 | Comp. Ex. 2 |
|---|---|---|---|---|---|---|---|
| Silicone rubber | 100 | 100 | 100 | 100 | 100 | 100 | 100 |
| Fiber length | | 50 μm | 150 μm | 250 μm | 130 μm | 100 μm | |
| Pitch-based XN-100 | 0 | 21 | 17 | 13 | 0 | 0 | 0 |
| PAN-based MLD-300 | 0 | 0 | 0 | 0 | 18 | 0 | 0 |
| Glass fiber | 0 | 0 | 0 | 0 | 0 | 12 | 0 |
| Measurement of difference in level (Peak value μm) | 18.6 | 1.1 | 0.8 | 1 | 1.7 | 1.6 | 17.5 |
| Martens hardness (N/mm$^2$) Depth 5 μm | 0.5 | 1.1 | 2.1 | 2.5 | 1.9 | 1.4 | 0.6 |
| Difference in temperature rise of the sheet end portion (° C.) | 27 | 14 | 10 | 9 | 20 | 27 | 27 |
| Image evaluation rank | 2 | 4 | 4 | 4 | 4 | 4 | 2 |

Comparative Example 1 and Comparative Example 2 have an abnormal image level in the image evaluation rank. The abnormal image level correlates with the values of the difference in level. It can be understood from the Comparative Examples 1 and 2 that an abnormal image is generated by the passing of a thick sheet. By contrast, the Examples 1 through 5 have extremely small differences in level. As a result, no abnormal image is observed in the image evaluation rank. The result of Martens hardness for the conventional configuration corresponds to the shape shown in FIG. 3, and the result of Martens hardness according to an embodiment of the present invention corresponds to the shape shown in FIG. 4. The Martens hardness is expressed as a size of stress with respect to a contact area of a probe unit, and it can be understood that the Examples are less deformable due to the fibrous fillers. The stress from above is received by the fibrous fillers and thus, stress needed to deform becomes larger. In addition, because the fibrous fillers are integrated with the elastic layer, stress is dispersed and the elastic layer is difficult to break in contrast to an example of JP-2009-103882-A in which an adhesive layer including fibrous fillers may come off from an elastic layer at the bonding interface. Furthermore, an additional effect is obtained. That is, when the pitch-based carbon fibers with high conductivity like those of Examples 1 to 3 are employed, temperature rise at the sheet end portion is also inhibited.

What is claimed is:

1. A fixing member for electrophotographic fixing, comprising:

a base body;

an elastic layer; and an outermost surface releasing layer, wherein the elastic layer and the outermost surface releasing layer are laminated on the base body, and the elastic layer is a continuous layer including fibrous filler, wherein the fibrous filler is limited to distribution in a portion of the elastic layer towards the outermost surface releasing layer, and wherein a content amount ratio of the fibrous filler to an elastic material of the elastic layer is from 10/100 to 30/100.

2. The fixing member of claim 1, wherein the fibrous filler a carbon fiber.

3. The fixing member of claim 2, wherein the carbon fiber is a pitch-based carbon fiber.

4. The fixing member of claim 1, wherein the fibrous filler is a glass fiber.

5. The fixing member of claim 1, wherein the elastic material of the elastic layer is a silicone rubber.

6. The fixing member of claim 1, wherein the outermost surface releasing layer includes a fluorine-based polymer material.

7. An electrophotographic fixing device comprising the fixing member of claim 1.

8. An image forming apparatus comprising:

a developing device; and the electrophotographic fixing device of claim 7, wherein the electrophotographic fixing device fixes a toner image developed by the developing device onto a medium.

* * * * *